US007154814B2

(12) United States Patent
Straka

(10) Patent No.: US 7,154,814 B2
(45) Date of Patent: Dec. 26, 2006

(54) DIGITAL ENGINE HOUR METER FOR OUTDOOR POWER EQUIPMENT

(75) Inventor: David A. Straka, Hudson, OH (US)

(73) Assignee: Delta Systems, Inc., Streetsboro, OH (US)

( * ) Notice: Subject to any disclaimer, the term of this patent is extended or adjusted under 35 U.S.C. 154(b) by 260 days.

(21) Appl. No.: 10/842,062

(22) Filed: May 10, 2004

(65) Prior Publication Data

US 2005/0249042 A1 Nov. 10, 2005

(51) Int. Cl.
*G04F 8/00* (2006.01)

(52) U.S. Cl. ..... 368/5; 368/8; 324/402; 377/16

(58) Field of Classification Search ..... 368/5–9; 324/402; 377/16
See application file for complete search history.

(56) References Cited

U.S. PATENT DOCUMENTS

| | | | | |
|---|---|---|---|---|
| 3,960,129 | A | 6/1976 | Hofer et al. | |
| 3,965,669 | A * | 6/1976 | Larson et al. | 368/9 |
| 4,985,875 | A | 1/1991 | Mitchell | |
| 5,121,368 | A | 6/1992 | Polydoris et al. | |
| 5,644,491 | A | 7/1997 | Fiske et al. | |
| 5,788,352 | A * | 8/1998 | Montroy et al. | 353/30 |
| 5,925,939 | A * | 7/1999 | Iwatani et al. | 307/10.1 |
| 6,377,168 | B1 * | 4/2002 | Harvey | 340/439 |

OTHER PUBLICATIONS

Brochure: Curtis Instruments, Inc.—*700 Series Solid State Hour Meters & Counters*, 7 pgs, Jun. 2002.

Technical Data 646: ENM Company—*Engine Powered Hour Meter, Series T60*, 2 pgs., 2002.

Printout: ENM Company—LCD Hour Meter catalog, www.enmco.com, 2 pgs, publication date unknown.

Printout: SenDEC Corporation—*Technical Data Sheet 806-10x Surface Mount*, www.sendec.com, 4 pgs, publication date unknown.

Printout: Honeywell/Hobbs Corp.—*LCD Hour Meters*, www.content.honeywell.com/sensing/hss/hobbcorp, 3 pgs., publication date unknown.

* cited by examiner

*Primary Examiner*—Kamand Cuneo
*Assistant Examiner*—Sean Kayes
(74) *Attorney, Agent, or Firm*—Tarolli, Sundheim, Covell & Tummino LLP

(57) ABSTRACT

A digital engine operating time measuring apparatus for an internal combustion engine. The apparatus is powered by a magneto of the engine and accumulates engine operating time only when the engine is operating. The apparatus includes power regulation circuitry including a pair of terminals coupled to the engine magneto. The power regulation circuitry converts a time varying electrical signal generated by the magneto when the engine is operating to a low voltage DC signal. The apparatus further includes digital circuitry coupled to an output of the power regulation circuitry for calculating accumulated engine operating time. The digital circuitry is powered by the low voltage DC signal of the power regulation circuitry and only accumulates engine operating time upon sensing the low voltage DC signal. The apparatus further includes a display coupled to the digital circuitry for displaying accumulated engine operating time as calculated by the digital circuitry.

31 Claims, 4 Drawing Sheets

DIGITAL ENGINE HOUR METER FOR OUTDOOR POWER EQUIPMENT

FIELD OF THE INVENTION

The present invention relates to an hour meter for outdoor power equipment and, more particularly, a digital hour meter for outdoor power equipment that is powered by a magneto of an internal combustion engine and accumulates engine operating time only when the engine is actually operating.

BACKGROUND ART

Engine operating time hour meters for outdoor power equipment including riding lawn mowers, lawn and agricultural tractors, snowmobiles, snowblowers, jet skis, boats, all terrain vehicles, bulldozers, generators, etc. are well known. Such engine operating time hour meters are provided, among other things, to let the owner and/or manufacturer know how long the equipment has been operated, when the equipment is due for repair/maintenance service, whether the equipment is still under warranty, etc.

With the widespread use of digital circuitry, digital engine operating time hour meters generally have replaced the old style mechanical hour meters which utilized rotating wheels. Digital hour meters provide improved accuracy and a digital display of accumulated hours. One shortcoming of some digital and mechanical prior art hour meters is that they accumulate hours of use of the equipment as soon as the ignition key or switch is turned on. Such hour meters provide an inaccurate measure of engine use. There may be instances where the ignition switch is on and the engine is not running, for example, an operator may inadvertently leave the ignition key in the on position after use of the equipment is completed and the engine is off. If the hour meter is accumulating time when the ignition switch is on the accumulated hours on the hour meter will overstate the true engine operating hours. Since warranty and service intervals are generally based on hours of engine operation, accumulating hours on the hour meter when the ignition key is on will result in premature indication that maintenance is needed and/or premature expiration of warranty, both to the disadvantage and dissatisfaction of the equipment owner.

As the manufacturer and owner of power equipment generally want to know the hours that the most expensive component of the equipment, namely, the engine has been operated, it is desired to have an hour meter that accumulates hours only when the engine is actually on. Certain prior art hour meters have attempted to address this issue. Generally, such prior art hour meters include two terminals which are coupled to the engine battery (generally 12 volts DC) and further include a third or enable terminal. Such hour meters only accumulate hours when the third terminal is enabled, that is, the third terminal receives a signal indicating that the engine is operating. One prior art hour meter utilizes three terminals, two of which are coupled to an internal DC power source of the hour meter and a third terminal is coupled to a spark plug wire and only accumulates time if the spark plug is firing. A disadvantage of such three terminal hour meters is that they necessarily include three terminals, two for power and a third terminal which must be enabled for accumulation of time. An additional disadvantage of the three terminal hour meter with an internal power source is that the power source eventually runs down necessitating a new power source being installed.

What is needed is a digital hour meter that utilizes only two terminals and accumulates engine operating time only when the engine is operating. What is also needed is a digital hour meter that is powered by a magneto of the engine and only accumulates engine operating time when the magneto is powering the hour meter. What is also needed is a versatile digital hour meter that can be powered by an engine magneto or the engine battery and is polarity insensitive.

SUMMARY OF THE INVENTION

One exemplary embodiment of the present invention is directed to a digital engine operating time measuring apparatus for an internal combustion engine which accumulates hours only when the engine is operating. The operating time measuring apparatus includes:

a) power regulation circuitry including a pair of terminals coupled to a magneto of the engine, the power regulation circuitry converting the time varying electrical signals generated by the magneto when the engine is operating to a low voltage DC signal;

b) a digital integrated circuit coupled to an output of the power regulation circuitry and calculating accumulated or elapsed engine operating hours, the digital integrated circuit powered by and accumulating hours only when the low voltage DC signal is generated by the power regulation circuitry; and c) a display coupled to the digital integrated circuit for displaying accumulated engine operating hours calculated by the digital integrated circuit.

Preferably, the digital integrated circuit is a microprocessor and, more specifically, a programmable integrated circuit (PIC) chip and the display is a liquid crystal display.

In one aspect of the present invention the power regulation circuitry includes a full wave rectifier for converting the time varying electrical signals generated by the magneto to a DC signal. In one preferred embodiment, the power regulation circuitry includes a temperature compensation circuit including a thermistor for changing a magnitude of the low voltage DC signal generated by the power regulation circuitry to compensate for a change in a magnitude of a threshold voltage of the display resulting from changing ambient temperature in the vicinity of the display.

Advantageously, the apparatus of the present invention is versatile and may be powered by an time varying signal such as an AC signal or by a DC signal and may be powered by a pulsed signal such as a magneto signal, whether the magneto output is a positive or a negative going signal. Although not preferred, the apparatus may be coupled to and powered by an engine battery and ignition switch. In this situation, the accumulated engine operating time will reflect a number of hours the battery is turned on.

These and other objects, advantages, and features of the exemplary embodiment of the invention are described in detail in conjunction with the accompanying drawings.

DETAILED DESCRIPTION

Figure 1:
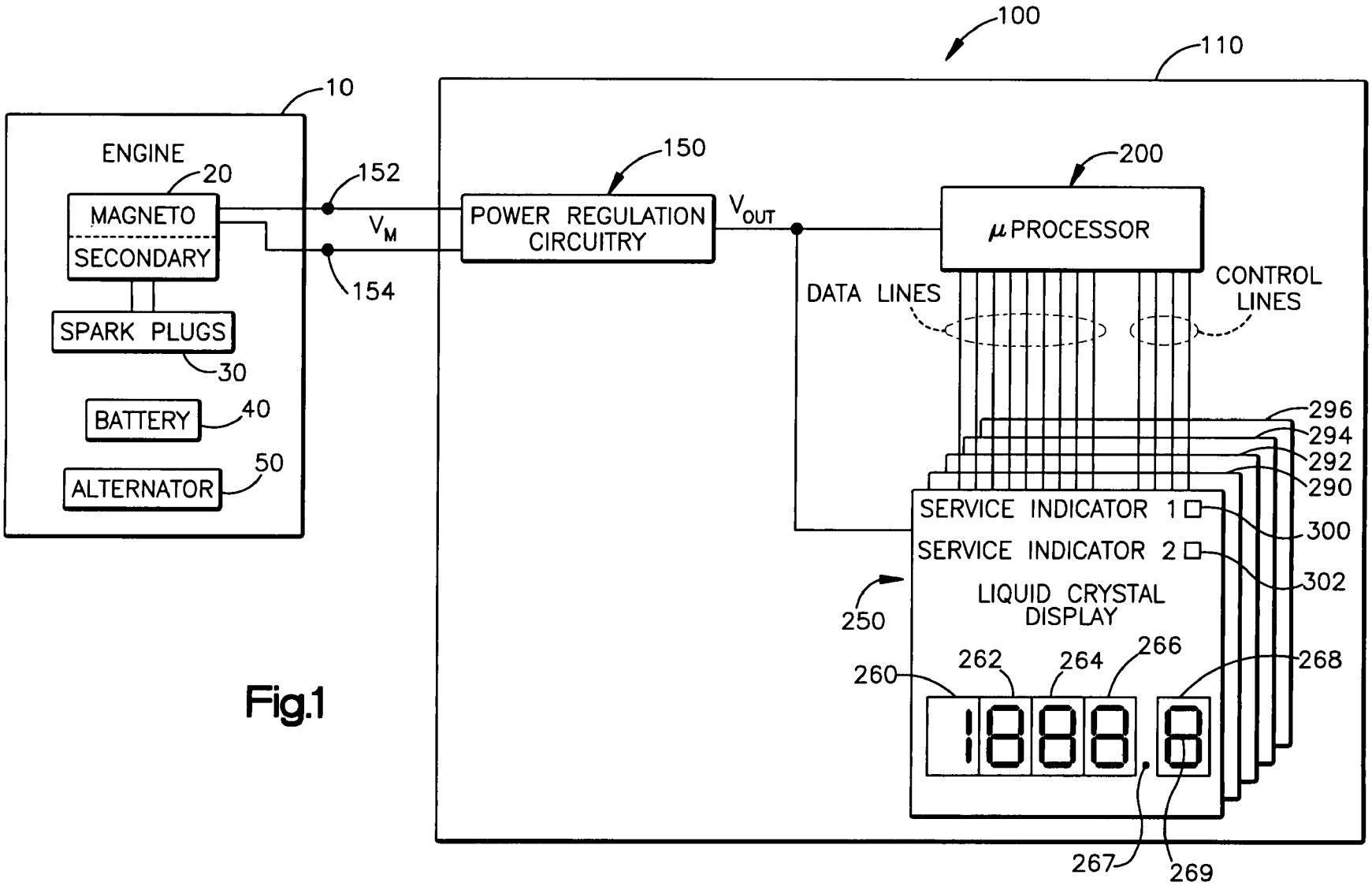
FIG. 1 is a schematic block diagram of an hour meter of the present invention.
Figure 2:
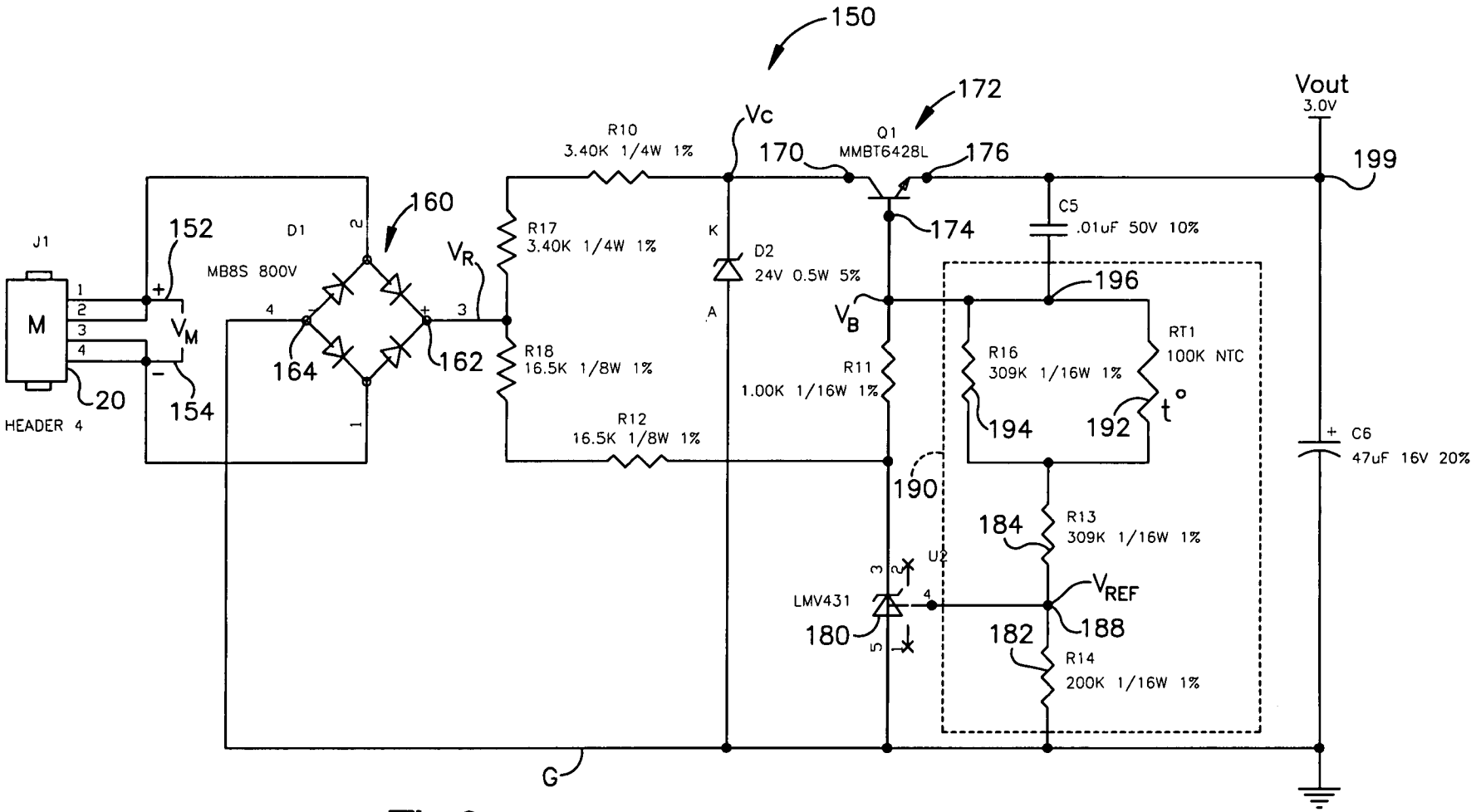
FIG. 2 is a circuit diagram of a power regulation circuitry module of the hour meter of FIG. 1.

Turning to the drawings, a block diagram of an a digital engine operating time measuring apparatus of the present invention is shown generally at 100 in FIG. 1. The apparatus 100, which will be referred to herein as an hour meter, is normally used in conjunction with a piece of outdoor power equipment or vehicle including an internal combustion engine 10. The hour meter 100 displays, via a liquid crystal display 250, an accumulated time in hours that the engine has been operated.

Typically, the hour meter 100 is mounted on a dashboard of outdoor power equipment such as a tractor, snowmobile, riding lawn mower, personal water craft or boat to inform the owner of the number of hours that the engine has been operated since the equipment was manufactured. However, it should be understood that the hour meter 100 of the present invention can be utilized with any type of internal combustion engine and is not limited to any particular type of equipment or vehicle. For ease of installation and compactness, circuitry and the liquid crystal display 250 of the hour meter 100 is mounted to a printed circuit board 110. The circuit board 110, in turn, is conveniently plugged into a socket (not shown) disposed beneath the dashboard of the power equipment and coupled to the output of the magneto 20. The magneto 20 is a transformer device and typically the hour meter 100 is coupled to a primary side of the magneto 20. Advantageously, because of the power regulation circuitry 150 (discussed below), the circuit board 110 is polarity insensitive and may be plugged into the socket in either direction, that is, either terminal of the power regulation circuitry may be coupled to either terminal of the magneto output.

The hour meter 10 of the present invention 100 advantageously is powered by and senses an output signal of a magneto 20 of the engine 10 and accumulates engine operating time only when the output signal of the magneto is sensed. The magneto 20 essentially is an AC generator with one or more permanent magnets that produce a pulsed, time varying AC output signal. The magneto output signal is typically on the order of 150–400 volts peak and of a duration of up to 2 milliseconds. A secondary side of the magneto 20 is coupled to a spark plug or plugs 30 of the engine 10 and utilized to fire the spark plug(s) 30. By grounding the magneto 20, the engine 10 is turned off because the spark plugs 30 will not fire. Thus, operation of the magneto 20 is necessarily concurrent with operation of the engine 10.

As noted above, the hour meter 10 only accumulates engine time when operation of the magneto 20 is sensed, thus, the hour meter 100 necessarily accumulates time only when the engine is operating. Further, since the hour meter 100 is also powered by the magneto output signal, it is advantageously a two terminal device, eliminating the need for a third terminal which is enabled by a logic or other signal to accumulate engine operating time.

Additionally, as will be explained below, the hour meter 100 includes robust power regulation circuitry 150 that allows the hour meter 100 to operate on an AC or DC input and with a wide range of input signal magnitudes, from 35 V AC to a pulsed 600 V peak and from 7–50 V DC. The power regulation circuitry 150 of the hour meter can operate regardless of polarity, that is, it can operate on AC signals having either positive or negative going waveforms and on DC signals which are positive or negative with respect to ground. Since the power regulation circuitry 150 of the hour meter 100 will operate on a DC signal, if a manufacturer of a piece of equipment desired, the hour meter 100 could be coupled to a DC battery 40 and ignition switch of the equipment and, in such a configuration, would accumulate time that the battery is turned on., i.e., the ignition key or switch is turned to the on position. The hour meter 100 is advantageously backwards compatible with existing prior art hour meters. Alternately, the hour meter 100 could be coupled to an alternator 50 of the equipment and would accumulate time when engine 10 and, therefore, the alternator are on.

In one preferred embodiment, the hour meter 10 is a high impedance, low operating current digital device that includes the power regulation circuitry 150. An output of the power regulation circuitry is coupled to and provides power to a digital integrated circuit 200 and to a display 250, preferably a liquid crystal display. The display 250 will display an elapsed time that the engine 10 has been operated. Although the display 250 is preferably a liquid crystal display, one of ordinary skill in the art will recognize that any display suitable for operation by digital output from the digital integrated circuit 200 could be utilized, for example, an LED display or plasma display.

Additionally, as will be discussed below, the digital integrated circuit 200 is preferably a microprocessor and, more particularly, a PIC chip. However, it should be recognized that other types of digital circuits and digital integrated circuits, know to those of skill in the art, could equally well be used such as, for example, without limitation, microcontrollers, programmable controllers, application specific integrated circuits (ASIC) and field programmable gate arrays (FPGA). Although the term "microprocessor" will be used herein in connection with reference number 200, it should be understood that the term microprocessor should be broadly interpreted to encompass any type of digital circuitry or digital integrated circuit.

In addition to the display of accumulated engine time, advantageously, the display 200 may include one or more visible service indicator displays. In the illustrated embodiment, two service indicator displays 300, 302 (FIG. 1) are shown. A service indicator display is energized by the microprocessor 200 when the accumulated engine time reaches a predetermined value. A service indicator display may indicate, for example, the need for servicing the engine 10 upon operation of the engine for a predetermined number of hours. In one preferred embodiment, the service reminder displays 300, 302 are reset after the reminder is displayed for two operating hours.

Power Regulation Circuitry 150

The hour meter 100 is a two terminal device, as such, the power regulation circuitry 150 includes a pair of terminals 152, 154 that are coupled to positive and negative primary side outputs of the magneto 20. Depending on the electrical characteristics of the magneto 20, the pulsed output voltage, $V_M$, of the magneto 20 may be comprised of positive-going voltage pulses, negative-going voltage pulse, or AC-type pulses, that is, pulses that include both positive and negative-going voltage components. The pulsed output voltage, $V_M$, is present across the terminals 152, 154. The terminals 152, 154 are coupled to a full wave bridge rectifier 160 of the power regulation circuitry 150. A suitable bridge rectifier is sold by Fairchild Semiconductor Corporation as part no. MB8S (Fairchild Semiconductor Corporation, South Portland, Me., web site—www.fairchildsemi.com). The bridge rectifier 160 rectifies magneto output voltage, $V_M$, and outputs a positive DC voltage signal, $V_R$, at node 162. The rectifier 160 is coupled to ground G at node 164.

The magnitude of the DC voltage, $V_C$, applied to a collector 170 of an NPN bipolar junction switching transistor 172 is clamped or limited to a maximum of 24 V DC by a 24 volt zener diode 170 coupled between the collector 170 and ground G. When there is no voltage output by the engine magneto 20 (engine 10 is off), there is no voltage, $V_B$, at the base of the switching transistor 172 and the switching transistor is off. The output voltage, $V_{OUT}$, present at output node 199 of the power regulation circuitry accordingly is zero. When the engine 10 is on, there is a 150–400 V pulsed voltage output by the magneto 20, this results in a sufficient voltage, $V_B$, at the transistor base 174 to turn the transistor 172 on and establish an output voltage, $V_{OUT}$, at node 199. At room temperature (25° C.) the output voltage, $V_{OUT}$, is 3.0 V DC.

When the magneto 20 is on, a shunt regulator 180 establishes a reference voltage, $V_{REF}$, of 1.24 V DC at node 188. One acceptable shunt regulator is National Semiconductor Corporation part no. LMV431Al (National Semiconductor Corporation, Santa Clara, Calif., web site—www.national.com). The reference voltage, $V_{REF}$, of 1.24 V DC at node 188 causes current to flow upwardly through a pair of series coupled resistors 182, 184 (200 KΩ and 309 KΩ, respectively) and through a parallel combination of a 100 KΩ thermistor 192 and a 309 KΩ resistor 194. The current flow through the resistors caused by the shunt regulator 180 establishes a voltage value of 3.6 V DC at the node 196 and, therefore, establishes the same voltage value ($V_B$=3.6 V) at the base 174 of the transistor 172.

The signal present at an emitter 176 of the transistor 172 defines the output voltage, $V_{OUT}$, of the power regulation circuitry 150. As can be seen, the output node 199 of the power regulation circuitry 150 is coupled to the transistor emitter 176. A 47 microfarad charging filter capacitor 188 is coupled between the output node 199 of the power regulation circuitry and ground G.

One advantageous feature of the power regulation circuitry 150 is temperature compensation. It has been found that the threshold voltage of the liquid crystal display 250 changes with temperature, namely, as the ambient temperature in the vicinity of the liquid crystal display 250 increases, the threshold voltage of the display decreases and as the ambient temperature decreases, the threshold voltage of the display increases. Since the expected operating temperature range of the hour meter is −30° C. to +80° C. the temperature sensitivity of the liquid crystal display 250 can be a problem.

If the output voltage of the power regulation circuitry 150 does not compensate for the changing threshold voltage of the liquid crystal display as the engine of the power equipment on which the hour meter 10 is installed heats up during use, the threshold voltage may drop low enough that all the segments of the liquid crystal display 250 will be energized by nominal background voltage thereby resulting in a nonsensical meter reading.

Therefore, a temperature compensation circuit 190 is provided as part of the power regulation circuitry 150. The temperature compensation circuit 190 includes the 309 KΩ resistor 184 coupled in series with the thermistor 192 and the 309 KΩ resistor 194, which are coupled in parallel. The thermistor 192 is a device with a high negative temperature coefficient of resistance meaning that as its temperature increases, its resistance decreases. One suitable thermistor is Murata Electronics part no. NCP18WF104J03R (Murata Electronics North America, Inc., Smyrna, Ga., web site—www.murata-northamerica.com).

At 25° C. (room temperature), the voltage, $V_B$, present at the base 174 of the transistor 170 is 3.6 V DC. The output voltage, $V_{OUT}$, present at output node 199 is the base voltage, $V_B$, less the base-emitter junction voltage drop of approximately 0.6 V. Therefore, at room temperature, the output voltage, $V_{OUT}$, of the power regulation circuitry is approximately 3.0 V DC.

Because of the negative coefficient of resistance of the thermistor 192, as the ambient temperature in the immediate vicinity of the hour meter 100 increases (and, therefore, the temperature of the thermistor 192 necessarily increases), the base voltage, $V_B$, will decrease from the nominal 3.6 V value, thereby decreasing the output voltage, $V_{OUT}$. Thus, as the threshold voltage of the liquid crystal display 250 decreases with an increase in temperature in the vicinity of the hour meter 10, the power regulation circuit output voltage, $V_{OUT}$, also decreases to avoid undesired energization of all display segments. Conversely, as the ambient temperature in the vicinity of the hour meter 100 decreases, the base voltage, $V_B$, will increase above the nominal 3.6 V value, thereby increasing the output voltage, $V_{OUT}$ of the power regulation circuit 150. Thus, as the threshold voltage of the liquid crystal display 250 increases with a decrease in temperature in the vicinity of the hour meter 10, the power regulation circuit output voltage, $V_{OUT}$, also increases to compensate.

Microprocessor 200

Figure 3:
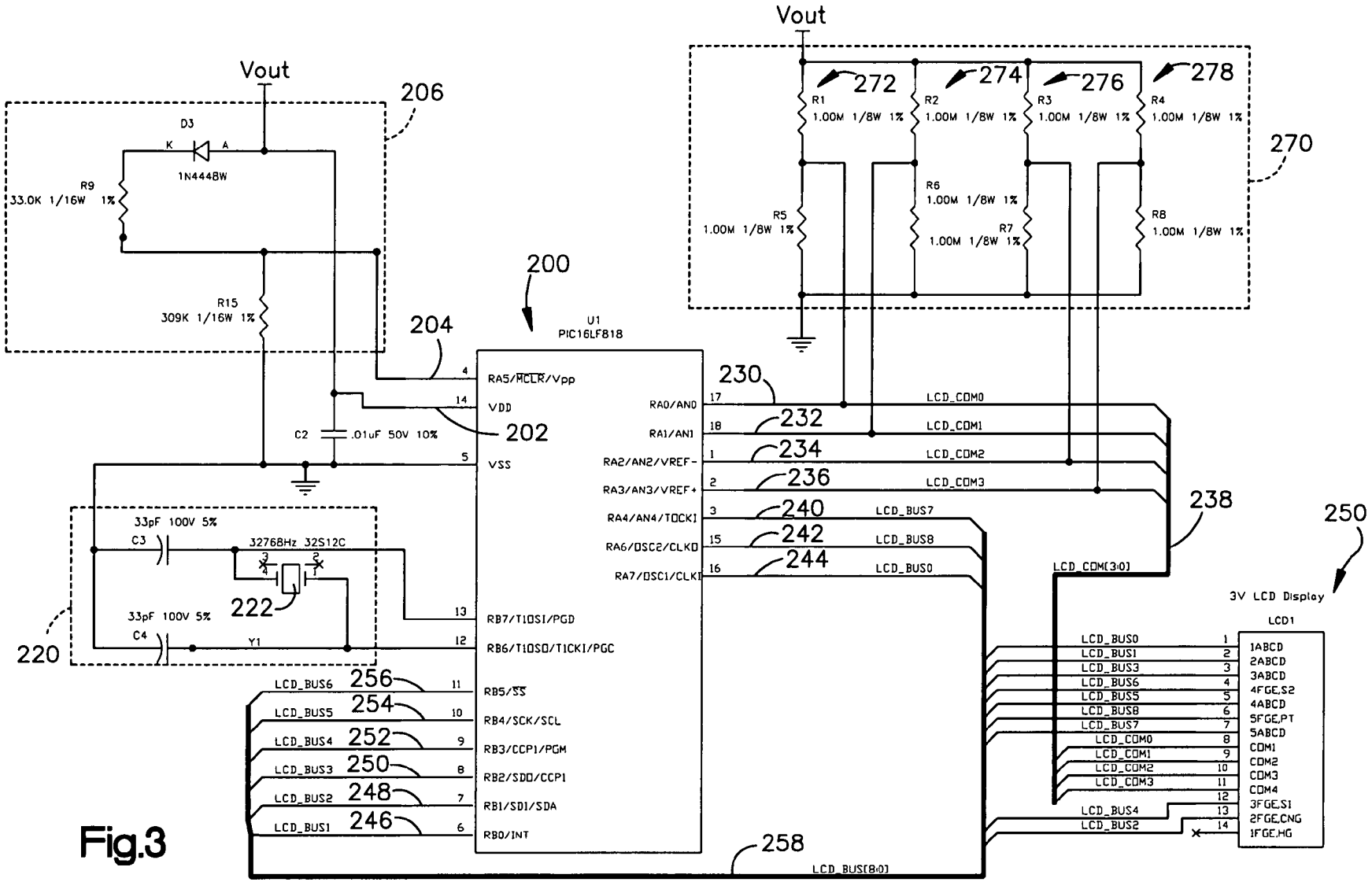
FIG. 3 is a circuit diagram of a microprocessor module and display module of the hour meter of FIG. 1.

As can best be seen in FIG. 3, the output voltage, $V_{OUT}$, of the power regulation circuitry 150 is coupled to and powers the microprocessor or microcontroller 200 and the liquid crystal display 250. Preferably, the microprocessor is a 16 bit, low power programmable microprocessor or microcontroller, such as the PIC 16 LF 818 chip commercially available from Microchip Technology, Inc., 2355 W. Chandler Blvd., Chandler, Ariz. 85224, web site—www.microchip.com).

Output voltage node 199 of the power regulation circuitry 150 is coupled to line 202 of the microprocessor. Coupled to a reset line 204 of the microprocessor is a delay circuit 206 that provides for resetting the microprocessor 200 prior to power loss from the power regulation circuitry 150 when the engine 10 is shut off. An external timer or clock circuit 220 including a crystal 222 that oscillates at 32768 Hertz is coupled to the microprocessor 200 to permit the microprocessor to accurately accumulate elapsed time that the engine 10 is on, that is, the time that the microprocessor 200 is powered up.

Figure 4:
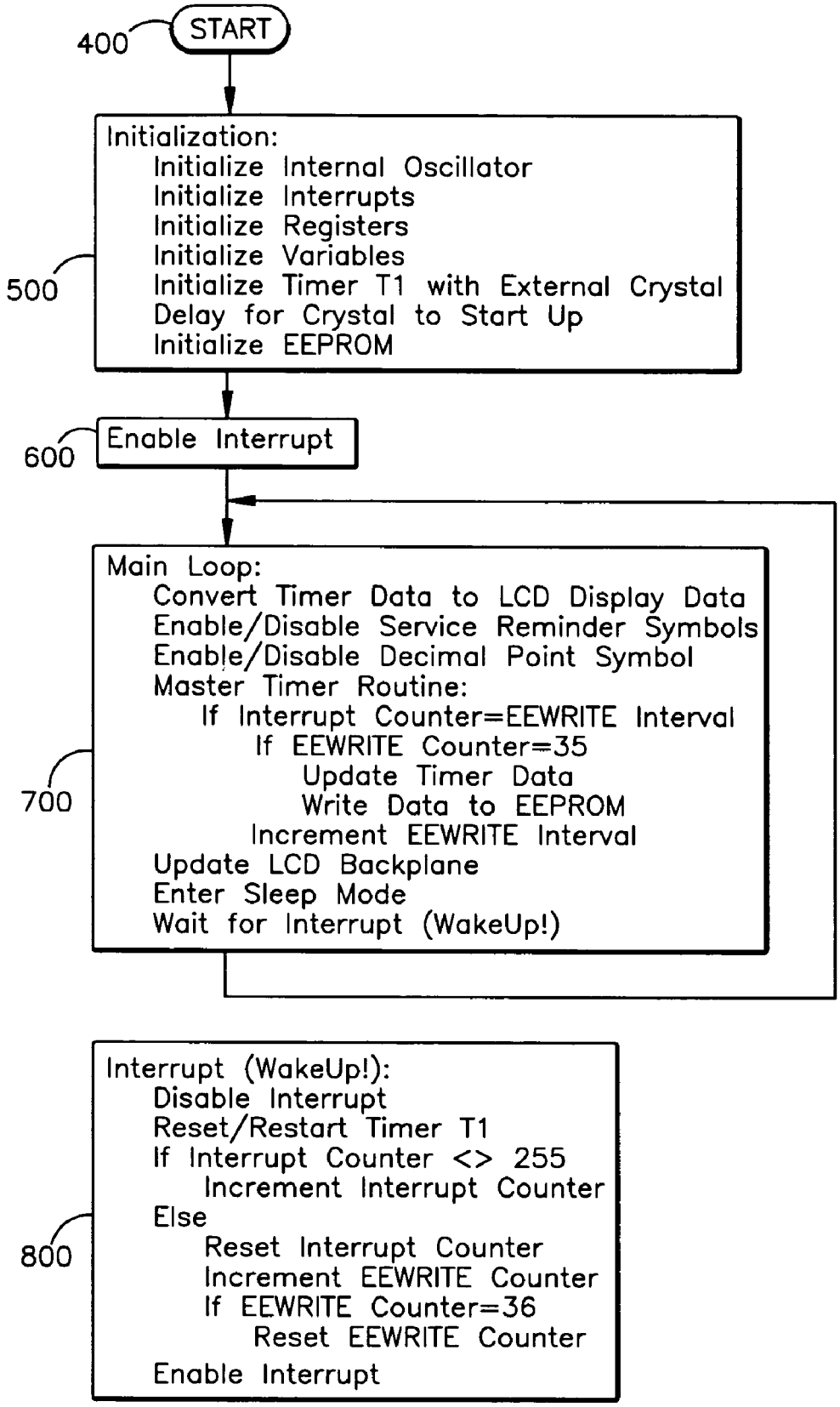
FIG. 4 is a flow chart of firmware custom code programmed into the microprocessor.

The microprocessor 200 is programmed with custom programming code, a flow chart of which is shown in FIG. 4. As can be seen in FIG. 4, the program starts at step 400. At step 500, upon initial start up, the program initializes a 1 megahertz internal oscillator of the microprocessor 200, a timer T1 of the microprocessor 200, program interrupts and variables, microprocessor registers, and the external timer circuit 220 utilizing the crystal 222 and EEPROM memory.

At step 600, only one interrupt is used. This interrupt occurs when the microprocessor internal timer T1 reaches a predetermined value that is set during initialization. The internal timer T1 uses the external crystal 222 as its frequency source. During the interrupt routine, the internal timer T1 is stopped, reset, and restarted. Also, variables that are used to keep track of accumulated engine operating time and keep track of 'writing' to the EEPROM are checked, incremented, or cleared based on their respective values at that time.

At step 700, the logic of the main loop is shown. The main loop controls the updating of the liquid crystal display data (30 segment engine operating time display, two single segment service indicators 300, 302, and the single segment decimal point 267) and the writing of the engine operating hours data to the EEPROM. It also controls sending data to the LCD display 250 in a multiplexing fashion. Once the above functions have been addressed, the main loop puts the microprocessor 200 to "sleep". The microprocessor 200 will only "wake up" when the internal timer T1 interrupt occurs.

When 256 interrupts have occurred, a total time of approximately one second has passed and the variable eewr ctr (EEWRITE Counter) will be incremented. When eewr ctr has been incremented 36 times, a total of 36 seconds, or one hundredth of an hour, has passed. At this time eewr ctr will be reset to zero and the accumulated time date will be incremented and stored in EEPROM memory. The data stored includes: thousands, hundreds, tens, ones, tenths and hundredths of an hour. To keep a low power level in the module, the accumulated time data is programmed into the EEPROM memory using the variable wr intbl (EEWRITE interval) in a "time staggered" fashion. The display data used to drive the segments of the display 250 are updated when the eewr ctr variable is reset to zero 100 times. This is equivalent to one tenth of an hour. When the "tenths" data is incremented, the microprocessor 200 will check to see if either of two service indicators 300, 302 and/or a decimal point 267 should be turned on. Then the new time data will be shown on the display 250. The microprocessor 200 will enter the sleep mode until another time T1 interrupt occurs.

At step 800, the interrupt routine is shown which wakes up the microprocessor 200. Sleep mode is a function internal to the microcontroller 200. It puts the microprocessor 200 in a very low power consumption condition by disabling several of it internal functions. This low power mode is used to keep the amount of energy taken from the magneto output signal to be as low as possible. The microprocessor 200 spends approximately 75% of its time in sleep mode. When internal timer T1 reaches its maximum value, it triggers an interrupt to occur internal to the microprocessor 200. This interrupt, occurring every 3.906 milliseconds, 'wakes up' the microprocessor 200 and allows it to perform all its regular functions again. The timer T1 runs all the time, while the 1 megahertz internal oscillator only runs when the microprocessor 200 is not in the sleep mode. Timer T1 is the only part of the microprocessor 200 that is running during the sleep mode.

Display 250

The liquid crystal display 250 includes a display of five digits 260, 262, 264, 266, 268 (FIG. 1). The first digit 260 is a two segment display displaying the number "1" when operating hours equals or exceeds 1,000.0 hours. Each of the remaining digits 262, 264, 266, 268 is comprised of a seven segment display for a total of 4×7=28 display segments (one display segment is labeled as 269 in FIG. 1). The digit 268 displays engine hours in $1/10^{th}$ hour increments, thus a single display segment decimal point 267 is inserted between the digits 266, 268. Finally, the service displays 300, 302 each comprise a single display segment. The liquid crystal display 200 is powered by the 3 V DC output voltage, $V_{OUT}$, from the power regulation circuitry 150.

The microprocessor 200 drives the liquid crystal display 250 via four control lines 230, 232, 234, 236 coupled to a control line bus 238 and nine data lines 240, 242, 244, 246, 248, 250, 252, 254, 256 coupled to a data line bus 258. The data lines 240, 242, 246, 248, 250, 252, 254, 256 are coupled to the display segments via a front plate of the liquid crystal display. A 4:1 multiplex driving arrangement is used by the microprocessor 200 to drive each of the 33 display segments with the nine data lines and the four control lines. The control lines 230, 234, 236, 236 are each connected to one of four common backplanes (schematically shown as 290, 292, 294, 296 in FIG. 1) of the display 250. Each backplane is addressed individually by the microprocessor 200 for one fourth of the current display refresh rate. Thus, with the four backplanes 290, 292, 294, 296, each control line is activated only 25% of the time, that is, control line 230 is activated 25% of the time for backplane 290, control line 232 is activated 25% of the time for backplane 292, control line 234 is activated 25% of the time for backplane 294 and control line 236 is activated 25% of the time for backplane 296.

Power is applied to the liquid crystal display 250 through a set of bias or offset resistors 270 which act as 2:1 voltage dividers. The 1.5 V output from each of the four voltage dividers 272, 274, 276, 278 is coupled to a respective one of the control lines 230, 234, 236, 238.

While the present invention has been described with a degree of particularity, it is the intent that the invention includes all modifications and alterations from the disclosed design falling with the spirit or scope of the appended claims.

I claim:

1. A digital engine operating time measuring apparatus for an internal combustion engine powered by a magneto of the engine and which accumulates time when the engine is operating, the apparatus comprising:

a) power regulation circuitry including a pair of terminals coupled to the engine magneto, the power regulation circuitry converting a time varying electrical signal generated by the magneto when the engine is operating to a low voltage DC signal;

b) digital circuitry coupled to an output of the power regulation circuitry and calculating accumulated engine operating hours, the digital circuitry being powered by and accumulating hours only when the low voltage DC signal is generated by the power regulation circuitry; and c) a display coupled to the digital circuitry for displaying accumulated engine operating hours calculated by the digital circuitry.

2. The digital engine operating time measuring apparatus of claim 1 wherein the power regulation circuitry includes a full wave bridge rectifier for converting the time varying electrical signal generated by the magneto to the low voltage DC signal.

3. The digital engine operating time measuring apparatus of claim 1 wherein the display is powered by the low voltage DC signal output by the power regulation circuitry.

4. The digital engine operating time measuring apparatus of claim 1 wherein power regulation circuitry further includes a temperature compensation circuit which increases a magnitude of the low voltage DC signal output by the power regulation circuitry upon a decrease in ambient temperature and decreases the magnitude of the low voltage DC signal output by the power regulation circuitry upon an increase in ambient temperature, the temperature compensation circuit including a thermistor having a negative temperature coefficient of resistance.

5. The digital engine operating time measuring apparatus of claim 1 wherein the low voltage DC signal generated by the power regulation circuitry when the engine is operating is in a range of 2–5 volts.

6. The digital engine operating time measuring apparatus of claim 1 wherein the digital circuitry is a PIC microprocessor.

7. The digital engine operating time measuring apparatus of claim 1 wherein an external crystal is coupled to the digital circuitry for clocking operating time.

8. The digital engine operating time measuring apparatus of claim 1 wherein a delay circuit is coupled to the digital circuitry so that when the engine is turned off and the magneto output signal stops the delay circuit provides sufficient power to permit the digital circuitry to shut down appropriately.

9. The digital engine operating time measuring apparatus of claim 1 wherein a voltage divider/multiplexer is coupled between the digital circuitry and the display to permit 4:1 multiplexing.

10. The digital engine operating time measuring apparatus of claim 1 wherein the display is a liquid crystal display.

11. A digital engine operating time measuring apparatus for an internal combustion engine which is powered by an output signal of an engine magneto and which accumulates hours when the magneto output signal is sensed, the apparatus comprising:

a) power regulation circuitry coupled to and powered by the engine magneto output signal, the power regulation circuitry sensing the magneto output signal and converting the magneto output signal to a DC output signal;

b) a digital integrated circuit coupled to and powered by the DC output signal of the power regulation circuitry, the digital integrated circuit accumulating a running total of engine hours upon sensing the DC output signal of the power regulation circuitry; and c) a display coupled to the digital integrated circuit for displaying accumulated engine operating hours as calculated by the digital integrated circuit.

12. The digital engine operating time measuring apparatus of claim 11 wherein the power regulation circuitry includes a full wave bridge rectifier for converting the time varying electrical signal generated by the magneto to the DC output signal.

13. The digital engine operating time measuring apparatus of claim 12 wherein the power regulation circuitry further includes a zener diode coupled between an output of the full wave bridge rectifier and ground to limit a voltage output of the bridge rectifier to a predetermined value.

14. The digital engine operating time measuring apparatus of claim 11 wherein the power regulation circuitry includes a thermistor for compensating for temperature variation.

15. The digital engine operating time measuring apparatus of claim 11 wherein the low voltage DC signal generated by the power regulation circuitry when the engine is operating is in a range of 2–5 volts.

16. The digital engine operating time measuring apparatus of claim 11 wherein the digital integrated circuit is a PIC microprocessor.

17. The digital engine operating time measuring apparatus of claim 11 wherein an external crystal is coupled to the digital integrated circuit for clocking operating time.

18. The digital engine operating time measuring apparatus of claim 11 wherein a delay circuit is coupled to the digital integrated circuit so that when the engine is turned off and the magneto output signal stops the delay circuit provides sufficient power to permit the digital integrated circuit to shut down appropriately.

19. The digital engine operating time measuring apparatus of claim 11 wherein a voltage divider/multiplexer is coupled between the digital integrated circuit and the display to permit 4:1 multiplexing.

20. The digital engine operating time measuring apparatus of claim 11 wherein the display is a liquid crystal display.

21. A digital hour meter apparatus for an internal combustion engine, the apparatus comprising:

a) power regulation circuitry including a first and a second terminals coupled to a magneto of the internal combustion engine which is switched on when the engine is operating, the power regulation circuitry converting an electrical signal generated by the magneto to a low voltage DC signal, regardless of which of the first and second terminals is coupled to a positive side of the magneto and which of the first and second terminals is coupled to a negative side of the magneto;

b) a digital integrated circuit coupled to an output of the power regulation circuitry and accumulating time, the digital integrated circuit being powered by and accumulating hours only when the low voltage DC signal is generated by the power regulation circuitry; and c) a display coupled to the digital integrated circuit for displaying accumulated time as calculated by the digital integrated circuit.

22. The digital hour meter apparatus of claim 21 wherein the digital integrated circuit senses a presence of the low voltage DC signal of the power regulation circuitry and accumulates time upon sensing the low voltage DC signal.

23. The digital hour meter apparatus of claim 21 wherein the power regulation circuitry includes a full wave bridge rectifier for converting the electrical signal generated by the source of power to the low voltage DC signal.

24. The digital hour meter apparatus of claim 23 wherein the power regulation circuitry further includes a zener diode coupled between an output of the full wave bridge rectifier and ground to limit a voltage output of the bridge rectifier to a predetermined value.

25. The digital hour meter apparatus of claim 21 wherein the power regulation circuitry includes a thermistor for compensating for temperature variation.

26. The digital hour meter apparatus of claim 21 wherein the low voltage DC signal generated by the power regulation circuitry when the engine is operating is in a range of 2–5 volts.

27. The digital engine operating time measuring apparatus of claim 21 wherein the digital integrated circuit is a PIC microprocessor.

28. The digital hour meter apparatus of claim 21 wherein an external crystal is coupled to the digital integrated circuit for clocking operating time.

29. The digital hour meter apparatus of claim 21 wherein a delay circuit is coupled to the digital integrated circuit so that when the engine is turned off and the magneto output signal stops the delay circuit provides sufficient power to permit the digital integrated circuit to shut down appropriately.

30. The digital hour meter apparatus of claim 21 wherein a voltage divider/multiplexer is coupled between the digital integrated circuit and the display to permit 4:1 multiplexing.

31. The digital hour meter apparatus of claim 21 wherein the display is a liquid crystal display.

* * * * *